US005785104A

United States Patent [19]

Riley et al.

[11] Patent Number: 5,785,104

[45] Date of Patent: Jul. 28, 1998

[54] CONVERSION SYSTEM FOR TRAVERSE CURTAIN RODS

[75] Inventors: Paula Riley, New York; Kenneth V. Stevens, Brooklyn, both of N.Y.

[73] Assignee: New²rinkle, L.L.C., New York, N.Y.

[21] Appl. No.: 942,016

[22] Filed: Oct. 1, 1997

[51] Int. Cl.[6] ..... E04F 10/00

[52] U.S. Cl. ..... 160/38

[58] Field of Search ..... 160/38, 39, 19, 160/330, 348; 16/87.2, 87.4 R, 94 R, 94 D, 95 R, 95 D, 96 R, 96 D; 211/105.1, 105.2; 248/265, 261, 251

[56] References Cited

U.S. PATENT DOCUMENTS

| | | |
|---|---|---|
| 259,531 | 6/1882 | Grimm . |
| 378,086 | 1/1888 | Field . |
| 580,064 | 4/1897 | Stagg . |
| 3,297,075 | 1/1967 | Howell et al. . |
| 3,643,288 | 2/1972 | Olivari . |
| 3,644,961 | 2/1972 | Hachtel . |
| 3,693,210 | 9/1972 | MacFarlane et al. . |
| 3,983,600 | 10/1976 | Smith . |
| 3,991,435 | 11/1976 | Ford . |
| 4,014,072 | 3/1977 | Schumacher . |
| 4,085,480 | 4/1978 | Kromm et al. . |
| 4,282,630 | 8/1981 | Toder . |
| 4,308,637 | 1/1982 | Kucera . |
| 4,424,605 | 1/1984 | Squires et al. . |
| 4,765,022 | 8/1988 | Siegal et al. . |
| 4,782,554 | 11/1988 | Lawson . |
| 4,805,786 | 2/1989 | Miller . |
| 4,921,031 | 5/1990 | Wagner et al. . |
| 4,922,600 | 5/1990 | Peters . |
| 4,971,210 | 11/1990 | Blumenkranz et al. . |
| 4,999,874 | 3/1991 | White . |
| 5,039,049 | 8/1991 | Niemi . |
| 5,042,548 | 8/1991 | Attal . |
| 5,152,331 | 10/1992 | Barone . |
| 5,154,218 | 10/1992 | Subecz . |
| 5,191,922 | 3/1993 | Wade . |
| 5,259,520 | 11/1993 | Roggio et al. . |
| 5,295,595 | 3/1994 | Gobidas et al. . |
| 5,361,821 | 11/1994 | Barone . |
| 5,383,508 | 1/1995 | Pavlica et al. . |
| 5,404,601 | 4/1995 | O'Neill et al. . |
| 5,505,245 | 4/1996 | Badalamenti . |
| 5,570,490 | 11/1996 | Walsh et al. . |
| 5,642,595 | 7/1997 | Daniels et al. . |

*Primary Examiner*—David M. Purol
*Attorney, Agent, or Firm*—Notaro & Michalos P.C.

[57] ABSTRACT

A conversion system for a window curtain traverse rod has an elongated rod cover formed as an outer clamshell enclosing a soft, resilient inner core which is snap fit over the existing traverse rod to fully encase the rod and curtain eyelets. End-bracket cover boxes are fit over the wall mount brackets supporting the traverse rod and rod cover. Alternate embodiments of the end-bracket covers are provided. Various ornamental fittings may be attached to the end-bracket covers to further change the appearance of the window covering. Alternate embodiments of the rod cover and fittings are provided for hanging different types of curtains.

27 Claims, 5 Drawing Sheets

CONVERSION SYSTEM FOR TRAVERSE CURTAIN RODS

FIELD AND BACKGROUND OF THE INVENTION

The present invention relates generally to the field of window coverings and curtain rods and in particular to a new and useful apparatus and method for quickly and easily covering existing curtain traverse rods and associated hardware to redecorate a window with a different style.

Since about 1950, traverse rod curtain supports 10, such as shown in FIG. 1, have become popular hardware products for hanging curtains and draperies in residential home windows. FIG. 1 displays one half of a traverse rod curtain support 10. As seen in FIG. 1, a traverse rod 15 is formed as an elongated rod having at least one channel 16 open to one side (or to the ground). A system of cords (not shown), pulleys (not shown) and eyelets 14 which are fully or partially concealed within the traverse rod 15 allow pleated curtains hung from the eyelets 14 to be easily opened and closed.

Traverse rods are conventionally mounted to interior walls near the top corners of window openings. Pairs of brackets fastened to the wall with screws are typically used to secure the traverse rod to the wall and support the rod horizontally spaced from the wall. As shown in FIG. 1, support bracket 17 is secured to wall 18 by a plurality of screws 12. A second bracket 17 (not shown) is used to connect the other end of traverse rod 15 to wall 18 in a similar manner. Installation of traverse rods is time consuming and can be awkward or difficult when long traverse rods are used. To obtain an acceptable look, the traverse rod must be mounted horizontally level with the window, which requires either plumbing the brackets and/or using a level and tape measure to ensure the traverse rod is properly mounted.

Unfortunately for homeowners and consumers, curtain fashions change like all other home fashions and decorative materials. Some newer, more fashionable, curtain styles do not use traverse rods. For homeowners and decorators who would like to make over their existing rooms in a different style this causes a problem. For persons who rent their home but would like to redecorate or improve the look of their home, this problem is even greater.

To use newer styles of curtain supports, which may be more ornate, a homeowner must decide whether to remove the existing brackets and traverse rod, thereby exposing holes in the interior wall around the window and undoing several hours of labor. Then, the new curtain supports must be mounted and leveled and centered over the window. Any marred portions of the wall which will remain exposed must be patched, painted or covered, and the traverse rods must either be thrown out or stored.

In the case of a renter who would like to redecorate, the landlord may not approve of the change, since hardware must be replaced, or the renter may not have the space to store the old rods in anticipation of having to re-install them prior to leaving.

Many known window treatments simply disguise the traverse rod without permitting different types of curtains to be hung, such as in U.S. Pat. No. 5,505,245. The '245 patent discloses a foam half shell covered by fabric material which is clipped over the front of a traverse rod and the sides of mounting brackets to improve their appearance. The traverse rod still functions normally, and the curtain type cannot be changed. U.S. Pat. No. 5,039,049 teaches a similar solution using a molded plastic half shell which clips to the traverse rod. It is also known to cover these clip-on rods with a sleeve of fabric, such as in U.S. Pat. No. 5,259,520 and U.S. Pat. No. 4,999,874.

A solution for changing a closet hangar rod is taught by U.S. Pat. No. 4,971,210. A slidable spacer for a closet hangar rod is used to separate garments from one another and can slide along the hanger rod. The spacer has a clamshell structure and it is placed over the rod and snapped closed. The spacer lacks an interior material. Multiple spacers are used on a single rod. In one embodiment, the spacer is longer and has several circumferential indentations for holding two or three hangars which can be moved as a group on the spacer.

Other changeable curtain rod systems require their own unique support bracket, such as in U.S. Pat. Nos. 5,361,821 and 5,152,331, in which a foam core supports a piece of fabric wrapped around the core and held in a radial slot along the length of the core. The foam core is mounted on a specially shaped horizontal bracket for holding the foam core.

Each of these prior solutions either does not completely change the nature of an existing curtain traverse rod to a solid curtain rod, or the prior system requires its own unique support.

SUMMARY OF THE INVENTION

It is an object of the present invention to overcome the difficulties posed by changing home fashions set forth above and allow for cost-effective redecorating.

It is a further object of the invention to provide a conversion system for curtain rods to allow quick and easy changes between traverse rod and solid rod supported curtains.

Accordingly, a curtain traverse rod conversion system is disclosed which can be used to change an existing curtain traverse rod to a solid curtain rod, which may be more ornate or decorative. The conversion system has a clamshell rod cover surrounding a resilient, soft core which fully encloses the existing traverse rod and disables the eyelets of the traverse rod. End-bracket covers are used to disguise the support brackets, covering them like a box and mating with the ends of the rod cover. Finials or end caps may be mounted on the outer sides of the end-bracket covers. Decorative support elements and face panels may be connected to the end-bracket covers. The exteriors of the various covers may be textured, decorated or plain.

The conversion system of the invention may be applied to any existing traverse rod with minimal effort and does not require removal of any existing hardware. The components of the conversion system may be sized to fit any width window and mounting bracket.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 2:
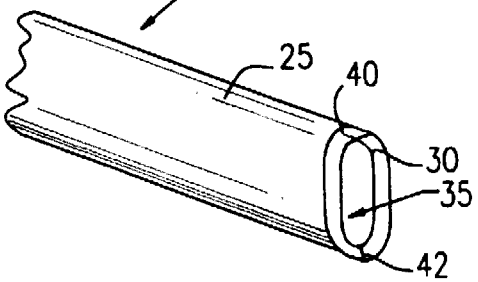
FIG. 2 is a front perspective view of a rod cover according to the invention.

Referring now to the drawings, in which like reference numerals are used to refer to the same or similar elements, FIG. 2 shows a rod cover 20 which is a part of the conversion system of the invention. Rod cover 20 has an outer shell 25 surrounding inner lining 30. The rod cover 20 is formed as a clamshell, with a split 40 between the sides of the outer shell 25 and inner lining 30 opposite a living hinge 42 at the bottom of shell 25. When the rod cover 20 is in a closed position, a channel 35 is formed through the rod cover 20 defined by the sides of the inner lining 30. Shell 25 is made of a suitable plastic, such as nylon or polyurethane, so as to be flexible for hinge 42, yet rigid to support curtain rings.

Figure 3:
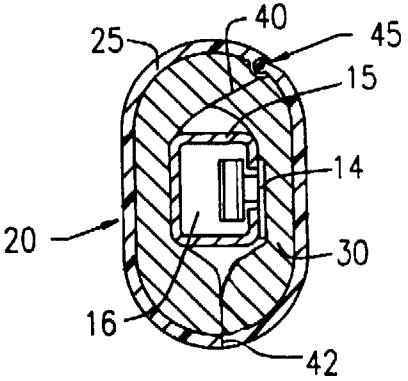
FIG. 3 is an end view of the rod cover of FIG. 2.
Figure 3A:
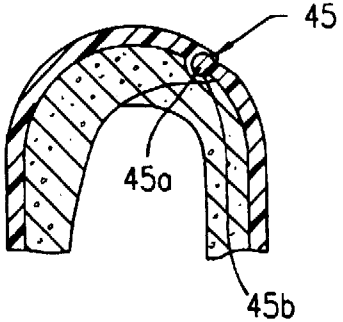
FIG. 3A is an enlarged sectional view of a snap connection for the rod cover.

FIG. 3 shows an end view of the rod cover 20 in greater detail with traverse rod 15 and its eyelets 14 immobilized by being squeezed between the lining 30 in outer shell 25. Snap connector 45 adjacent split 40 is used to hold the rod cover in a closed position. Snap connector 45 may be of any known type of snap closure which extends along the length of rod cover 20. As shown in FIG. 3A, snap connector 45 may be a cylindrical bead **45*a* that snaps into the mouth of an elongated C-channel 45*b***.

Figure 1:
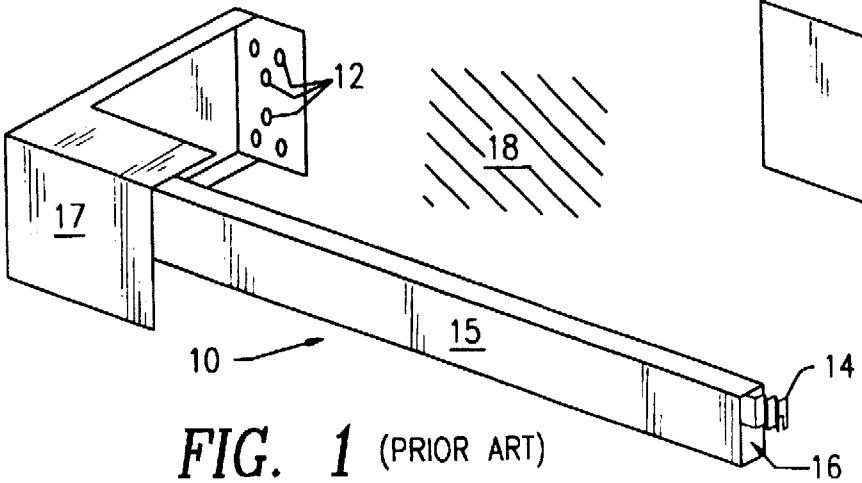
FIG. 1 (PRIOR ART)
FIG. 1 is a front perspective view of a conventional prior art traverse rod.

The rod cover 20 is used to convert an existing traverse rod 15 (FIG. 1) by first opening the clamshell halves of rod cover 20 at split 40, which is preferably oriented at the top, wall facing side of the shell 25, and placing the rod cover 20 around traverse rod 15. Then, the rod cover 20 is snapped closed, such that the inner lining 30 encases the traverse rod 15, which fills channel 35.

The outer shell 25 is preferably a hard surfaced material, such as formed plastic, as noted above. The inner lining 30 is a soft, resilient material, such as foam rubber or sponge, for adapting to the contours of the traverse rod 15 it surrounds in the channel 35. The resilient material prevents the eyelets 14 and other exposed components of the traverse rod 15 from moving or rattling within the rod cover 20.

Figure 4:
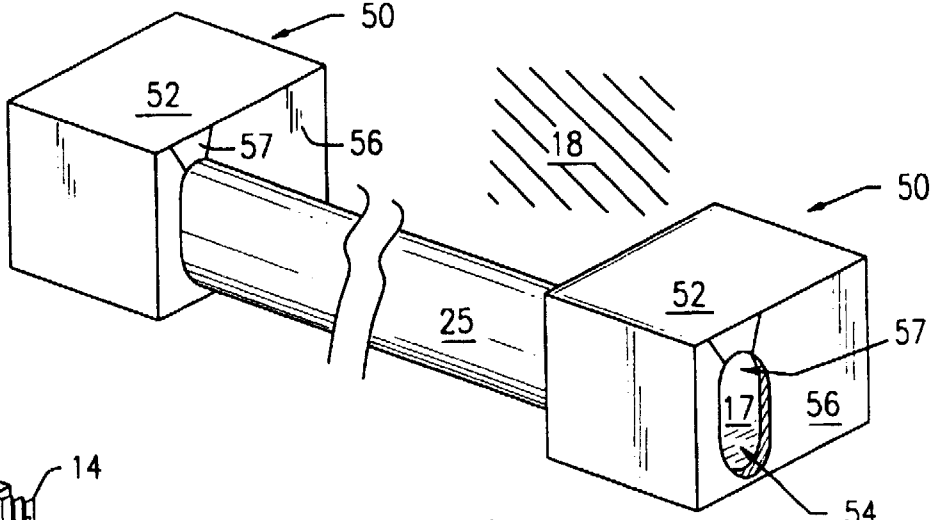
FIG. 4 is a front perspective view of a end-bracket cover of the invention.

Turning now to FIG. 4, a rod cover 20 is shown surrounding a traverse rod with a pair of end-bracket covers 50 encasing the pair of brackets 17 mounting the traverse rod to wall 18. End-bracket covers 50 are formed as boxes with side walls 56 and separable tops 52. The end-bracket covers 50 have openings 54 through each side wall 56 corresponding to the circumference of rod cover 20. The top portion of each opening 54 of the end-bracket covers 50 has a slot 57.

The slot 57 is provided so that the end-bracket cover 50 with the top 52 removed may be slipped over the bracket 17 from the bottom (or from the top) and the opening 54 adjacent the rod cover 20 is fit around the rod cover 20. The end-bracket cover 50 is positioned without removing any hardware of the existing traverse rod and with the rod cover 20 in place. The top 52 of the end-bracket cover 50 then snaps closed, closing the slot 57 and securing the end-bracket cover around the rod cover 20.

Figure 5:
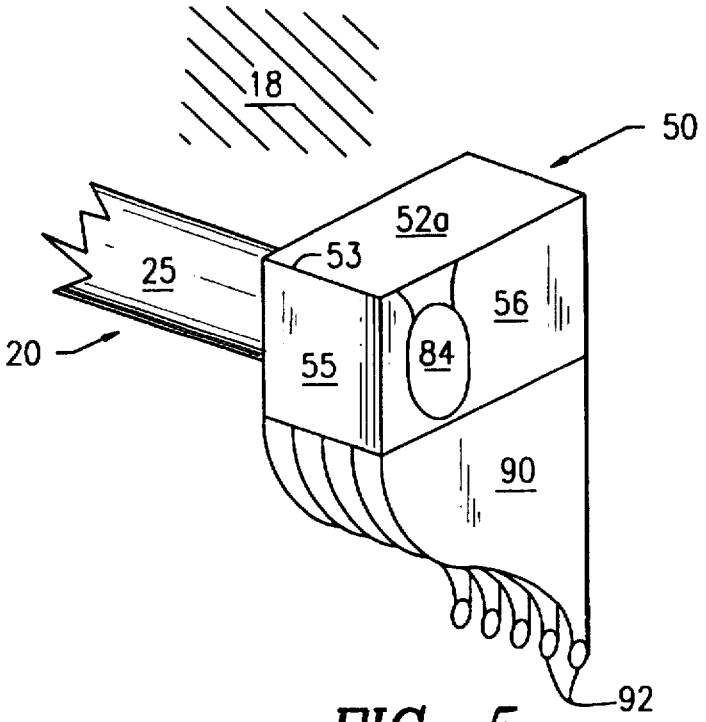
FIG. 5 is a front perspective view of an alternate embodiment of the cover in FIG. 4.

In an alternate embodiment shown in FIG. 5, the end-bracket cover 50 may have a hinged top **52*a*. The top 52*a* is connected to the end-bracket cover front by a living hinge 53. The hinge connection allows the top 52*a* to be pivoted open about hinge 53 when placing the end-bracket cover 50 over a bracket 17, and then snapped closed when the end-bracket 50** is in position.

A support bracket 90 is also shown in FIG. 5 positioned below the end-bracket cover 50. Support bracket 90 may be used both for decoration and for support of the original bracket by cantilevering the end-bracket cover 50 against wall 18. The support bracket 90 can be formed as an integral part of end-bracket cover 50, or it may be attached using a male-female snap fit connection. Support bracket 90 may also have hooks 92 or holes or other devices for hanging or swagging curtain material over in a decorative manner.

The opening 54 through the opposite side wall 56 is used to attach a decorative element, such as a finial 80, 82 (shown in FIG. 8), or simply a flat end cap 84 (as shown in FIG. 5) to close the opening 54. The finial 80, 82 or end cap 84 can be held in place using a male-female groove connection, such that when the end-bracket cover top 52, **52*a* is snapped into place, the finial 80, 82 or end cap 84 is also locked in place like the rod cover 20**.

Figure 6:
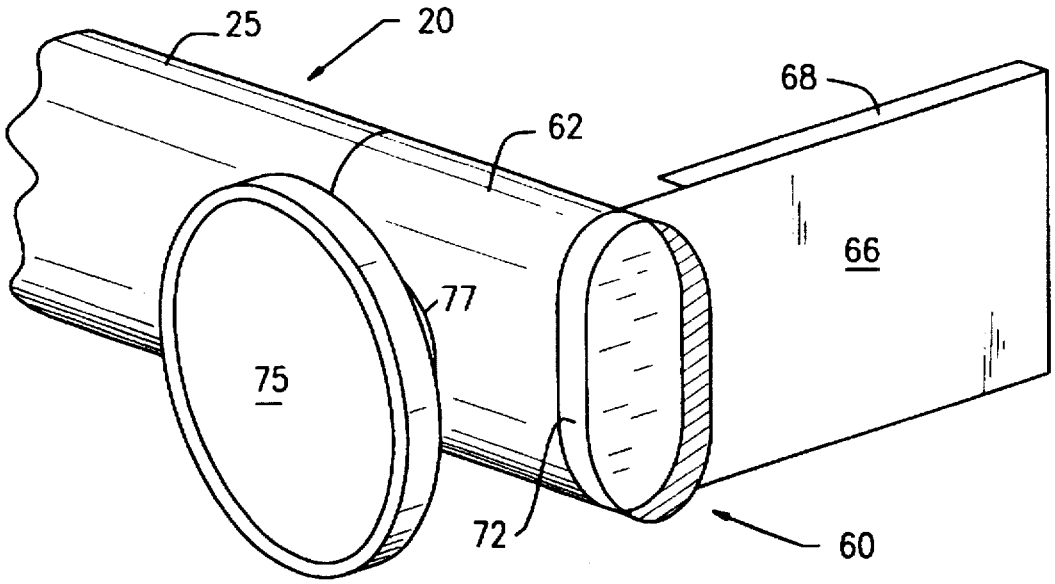
FIG. 6 is a front perspective view of a third embodiment of an end-bracket cover according to the invention.
Figure 7:
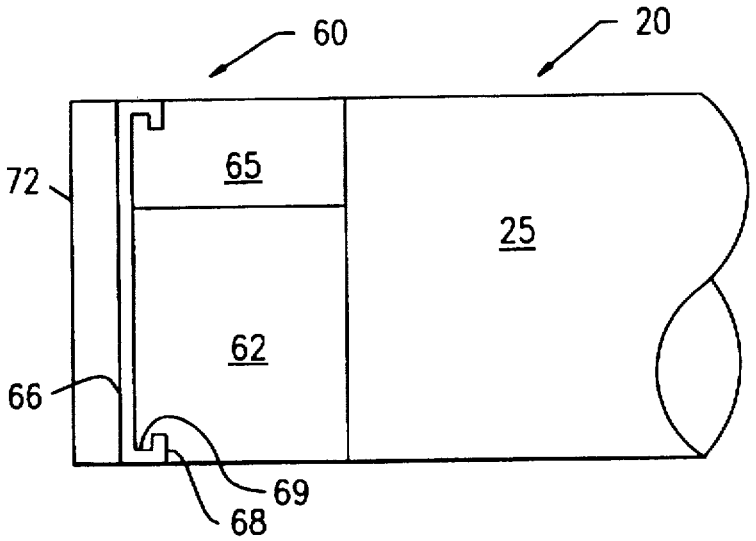
FIG. 7 is a rear elevational view of the end-bracket cover of FIG. 6.

In FIGS. 6 and 7, yet another embodiment of the end-bracket covers 60 is shown having a side cover 66 and front cover 62 connected together. End-bracket cover 60 fits over the sides and front of bracket 17 only using gripping prongs 68 lined with resilient strips 69.

Front cover 62 extends horizontally to conceal the front side of bracket 17 and aligns with the front side of outer is shell 25 of rod cover 20. A circular disk or rosette 75 is attached to the front cover 62 by a stud 77. The disk 75 may be used to drape or swag curtain or other material to further enhance the decorative nature of the window dressing.

Side panel 66 extends toward wall 18 from front cover 62 and has end connection 72 for attaching a finial 80, 82 or end cap 84 by a friction fit. Gripping prongs 68 extend from the top and bottom edges of side panel 66 to snap over the sides of bracket 17.

A gripping finger 65 extending between rod cover 20 and side panel 66 behind front cover 62 may be used to fasten these components together by either a male-female snap fit or a friction fit. The gripping finger 65 lends additional support strength to the structure of the conversion system.

Figure 8:
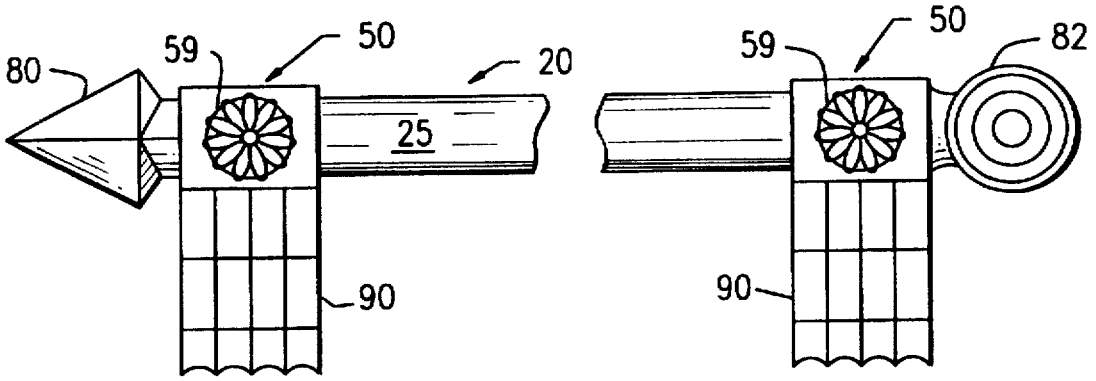
FIG. 8 is a front elevational view of the conversion system according to the invention.

A complete system using the end-bracket covers 50 is shown in FIG. 8. Cover rod 20 extends between end-bracket covers 50, which have finials 80, 82 extending outward from their sides opposite the cover rod 20. Support brackets 90 extend downward from the end-bracket covers 50. End-cover brackets 50 have ornamental designs 59 on their front faces. Ornamental designs 59 may be replaced by disk 75 and stud 77, or the disk 75 may bear the ornamental design 59. Finials 80 and 82 show two possible configurations and are used to provide the illusion of a continuous rod extending through the end-bracket covers 50.

The end-bracket covers 50 extend to wall 18 to completely conceal the original brackets 17. The end-bracket covers 50, 60 may be made of a textured material or covered with a particular design, but they are preferably made of plastic in order to reduce their weight and allow the covers 50, 60 to produced economically. Similarly, the finials 80, 82 and end caps 84 may also bear designs or a textured appearance and they are preferably made from plastic, but other materials may also be used, such as wood.

In use, the rod cover 20 is first placed over the existing traverse rod 15 and snapped shut. Then, end-bracket covers 50, 60 are positioned around the existing brackets 17 and openings 54 are oriented around rod cover 20. When end-bracket covers 50 are used, finials 80, 82 or end caps 84 should be inserted in the opposite side openings 54 before closing cover tops 52, 52*a* to secure the end-bracket covers and finials 80, 82 and or caps 84 in place. Alternate end-bracket covers 60 may be snapped into place over brackets 17 and aligned with rod cover 20 before or after attaching finials 80, 82 or end caps 84.

FIGS. 9, 9A, 10 and 10A show alternate embodiments for the rod cover 20*a*, 20*b* with fittings 105, 205 for hanging different types of curtains, while still changing the overall appearance of the original curtain traverse rod 15. The rod covers 20*a*, 20*b* function in the same way as rod cover 20. Each has an outer shell 25, inner lining 30, snap connector 45, channel 35, and hinge 42, so that the rod cover 20*a*, 20*b* may be placed around an existing traverse rod 15.

Figure 9:
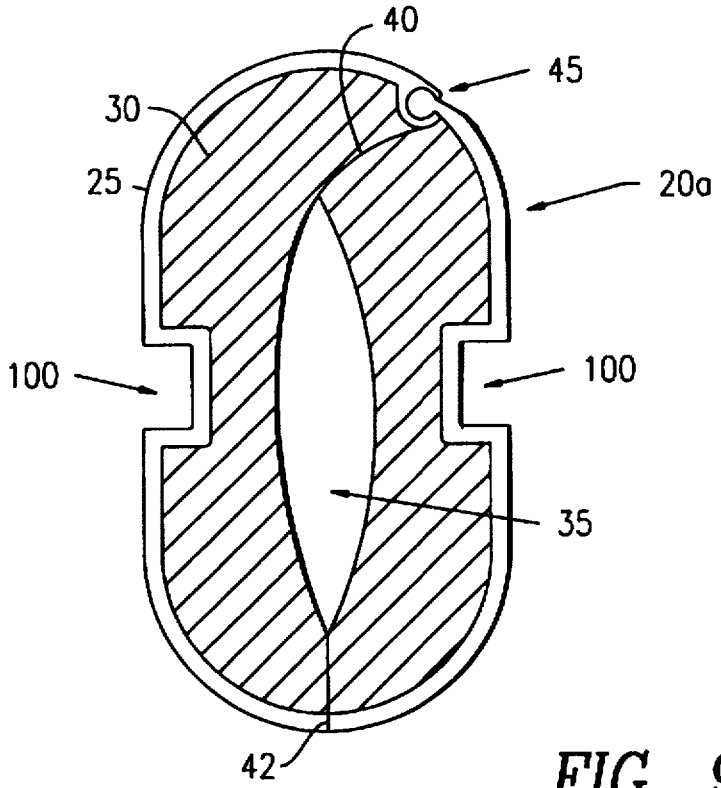
FIG. 9 is an end elevational view of an alternate embodiment of the rod cover of the invention.
Figure 9A:
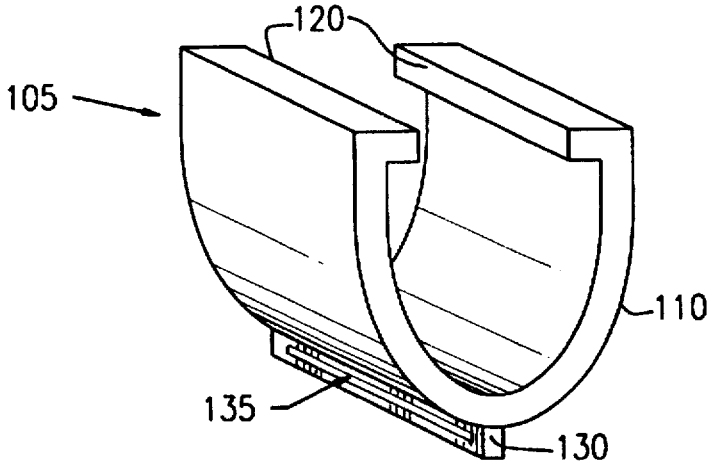
FIG. 9A is a right front perspective view of a fitting for the rod cover of FIG. 9.

The rod cover 20*a* shown in FIG. 9 has a pair of longitudinal grooves 100 down the sides of the rod cover 20*a*. The grooves 100 are formed by indentations in the sides of the outer shell 25. In FIG. 9A, a fitting 105 which is adapted to fit around rod cover 20*a* has flanges 120 corresponding to grooves 100 in rod cover 20*a*. The fitting 105 has a U-shaped body 110 from which a ridge 130 depends in a downward direction. The ridge 130 has a longitudinal slot 135 for placing hooks or other curtain supports therethrough. The fitting 105 may extend the entire length of rod cover 20*a*, or may be only a fraction of the total length of the rod cover 20*a*, so that several fittings 105 may be snapped fit into place along the length of the rod cover 20*a*. Fitting 105 may be ornate or plain, and can be used to further enhance the decorative aspects of the rod cover 20*a* as well.

Figure 10:
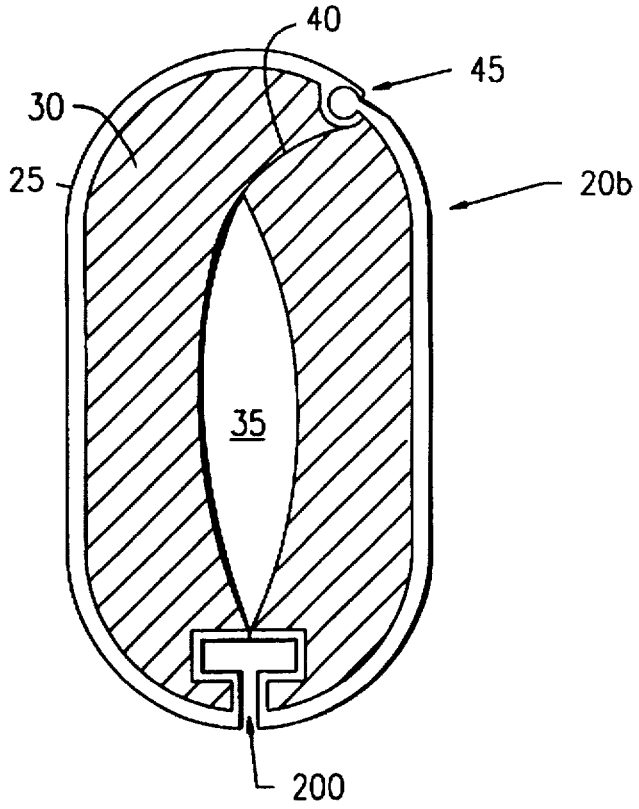
FIG. 10 is an end elevational view of another embodiment of the rod cover of the invention.
Figure 10A:
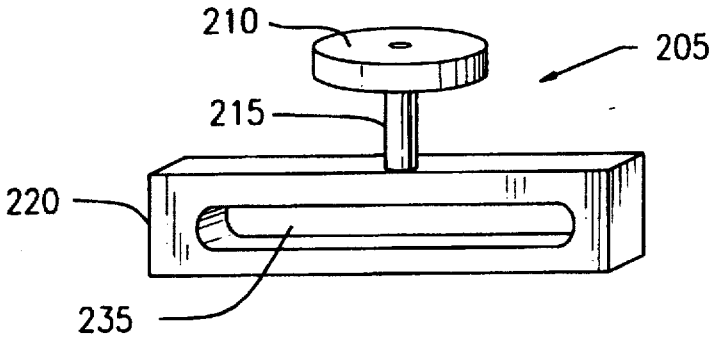
FIG. 10A is a right front perspective view of a fitting for the rod cover of FIG. 10.

In FIGS. 10 and 10A, the rod cover 20*b* has a T-channel 200 formed in the bottom of the outer shell 25. The T-channel 200 extends the length of rod cover 20*b*, and is adapted to receive a fitting 205 such as shown in FIG. 10A. The fitting 205 has a circular slider 210 from which a stem 215 depends downwardly. A bar 220 is connected to the stem 215. The bar may have a slot 235 therethrough, or alternatively, individual holes, for receiving curtain hooks or other curtain hanging apparatus. One or more fittings 205 may be used with the embodiment of the curtain rod 20*b* shown to hang the same style of curtains, while improving the appearance of a plain traverse rod 15.

In each case, additional fasteners are not required, and the entire conversion system can be snap-fit or friction fit into place with minimal effort. A homeowner or decorator does not require any tools to use the conversion system since none of the existing hardware is removed. Following use of the conversion system, the homeowner has a completely differently styled curtain rod assembly on which to hang a different type of curtain altogether without replacing or removing the pre-existing curtain traverse rod system. Further, the homeowner or decorator can easily revert back to the original traverse rod system, or change the appearance of the curtain rod by simply changing one or more components of the conversion system of the invention, such as the finials 80, 82 or support brackets 90. All parts of the invention can be made of plastic, including the bracket covers 50 and fittings 105, 205, but other materials may also be used.

Although the rod cover 20, 20*a*, 20*b* is shown as being oval or rounded and vertically elongated, cicular, square, rectangular or other polygonal shapes may be used. Further, the soft lining 30 may partly or completely fill shell 25 for compressing around traverse rod 15.

While a specific embodiment of the invention has been shown and described in detail to illustrate the application of the principles of the invention, it will be understood that the invention may be embodied otherwise without departing from such principles.

What is claimed is:

1. A conversion system for changing the appearance and style of a curtain traverse rod assembly having a traverse rod supported between a pair of brackets mounted to a wall and containing a plurality of movable eyelets, the conversion system comprising:

an elongated rod cover having a hard outer shell, and a soft inner lining inside of the outer shell defining a longitudinal channel through the rod cover, the rod cover for encasing the traverse rod within the longitudinal channel;

end-bracket cover means for changing the appearance of each of the pair of brackets by concealing each bracket from view, the end-bracket cover means being connected to opposite ends of the rod cover.

2. A conversion system according to claim 1, further comprising decorative means connected to the end-bracket cover means for providing a decorative appearance and simulating the appearance of a continuous curtain rod extending past the end-bracket cover means.

3. A conversion system according to claim 2, wherein the rod cover has a longitudinal living hinge in one side and a longitudinal split in a side opposite the living hinge.

4. A conversion system according to claim 1, wherein the rod cover has a longitudinal living hinge in one side and a longitudinal split in a side opposite the living hinge.

5. A conversion system according to claim 4, wherein the end-bracket cover means comprises a rectangular box having a pair of side panels having aligned openings therethrough, a front panel, a top panel which is separable from at least the pair of side panels, such that the top panel may be moved to open a slot in each side panel in communication with the corresponding opening, whereby the box may be positioned around the bracket and an adjacent end of the rod cover without disconnecting the bracket or traverse rod, the opening in the side panel adjacent the rod cover fitting around the adjacent end of the rod cover.

6. A conversion system according to claim 5, wherein the top panel is connected to the front panel by an end-bracket living hinge.

7. A conversion system according to claim 6, wherein the top panel is held in a closed position by one of a snap closure and a frictional fit.

8. A conversion system according to claim 5, wherein the top panel is removable from the rectangular box.

9. A conversion system according to claim 8, wherein the top panel is attached to the rectangular box by one of a snap closure and a frictional fit.

10. A conversion system according to claim 5, further comprising a finial attached to the rectangular box at the opening opposite the rod cover.

11. A conversion system according to claim 10, wherein the finial is axially aligned with the rod cover.

12. A conversion system according to claim 5, further comprising a support bracket connected to a bottom of the rectangular box and in contact with the wall when the rectangular box is in position around the bracket.

13. A conversion system according to claim 5, further comprising swagging means connected to the front panel of the rectangular box for draping a fabric or curtain material over.

14. A conversion system according to claim 4, wherein the end-bracket cover means comprises an end-bracket cover having a front panel connected to a side panel, the side panel having clip means for removably connecting the end-bracket cover to a side of the bracket, and a gripping finger means for connecting the cover rod to the end-bracket cover.

15. A conversion system according to claim 14, further comprising finial means for connecting a finial to the side panel of the end-bracket cover.

16. A conversion system according to claim 1, wherein the inner lining is a soft, resilient material.

17. A conversion system according to claim 1, further comprising finial means for connecting a finial axially aligned with the rod cover to the end-bracket means.

18. A conversion system according to claim 1, wherein the rod cover has an oval cross-section and the shell is a clamshell with a hinge at the bottom and a split at the top with closure means at the split for closing the clamshell.

19. A conversion system according to claim 1, including, in combination, a traverse rod assembly with a traverse rod and eyelets trapped in the soft inner lining, and at least one bracket enclosed in the end-bracket cover means.

20. A conversion system according to claim 19, wherein the rod cover has an oval cross-section and the shell is a clamshell with a hinge at the bottom and a split at the top with closure means at the split for closing the clamshell.

21. A conversion system according to claim 1, wherein a pair of longitudinal grooves are formed in the hard outer shell in opposing sides of the rod cover.

22. A conversion system according to claim 21, further comprising fitting means for fitting around a portion of the rod cover and supporting a curtain therefrom.

23. A conversion system according to claim 22, wherein the fitting means comprises a fitting having a pair of longitudinal flanges corresponding to the pair of grooves in the outer shell and a longitudinal ridge having one of a slot or a plurality of holes therethrough depending downwardly from the bottom of the fitting.

24. A conversion system according to claim 1, wherein a longitudinal T-channel is formed in the outer shell in the bottom of the rod cover.

25. A conversion system according to claim 24, further comprising fitting means supported within the T-channel for hanging a curtain therefrom.

26. A conversion system according to claim 25, wherein the fitting means comprises a slider and stem corresponding to the shape of the T-channel having hanging means for hanging a curtain connected to the stem.

27. A conversion system according to claim 26, wherein the hanging means comprises a bar having one of a longitudinal slot or a plurality of holes therethrough.

* * * * *